United States Patent [19]

Mikic et al.

[11] Patent Number: 4,627,164

[45] Date of Patent: Dec. 9, 1986

[54] WIRE STUB RETAINER AND HANDLE OPENING SPRING

[75] Inventors: Frank Mikic, Kenosha; Daniel W. Williams, Milwaukee, both of Wis.

[73] Assignee: Snap-on Tools Corporation, Kenosha, Wis.

[21] Appl. No.: 703,207

[22] Filed: Feb. 19, 1985

[51] Int. Cl.[4] ..... B26B 13/00

[52] U.S. Cl. ..... 30/135

[58] Field of Search ..... 30/131–135

[56] References Cited

U.S. PATENT DOCUMENTS

| | | | |
|---|---|---|---|
| 1,487,808 | 3/1924 | Rowen . | |
| 2,302,208 | 11/1942 | Glasener | 30/135 |
| 2,323,497 | 7/1943 | Strout . | |
| 2,553,697 | 3/1951 | Zacrep | 30/135 |
| 2,938,266 | 5/1960 | Klein | 30/124 |
| 3,126,628 | 3/1964 | Popek | 30/134 |
| 3,722,093 | 3/1973 | Kaufman | 30/124 |
| 3,763,560 | 10/1973 | Makkay et al. | 30/124 |
| 3,777,398 | 12/1973 | Routh | 30/124 |
| 3,842,500 | 10/1974 | Cassel | 30/124 |
| 3,908,268 | 9/1975 | Brown | 30/124 |
| 3,922,781 | 12/1975 | Tippy | 30/124 |
| 4,023,270 | 5/1977 | Hellerman et al. | 30/124 |
| 4,247,983 | 2/1981 | Jansson et al. | 30/124 |
| 4,404,746 | 9/1983 | Jansson et al. | 30/124 |

*Primary Examiner*—Douglas D. Watts

*Attorney, Agent, or Firm*—Emrich & Dithmar

[57] ABSTRACT

A clip-like, resilient wire stub retainer and handle opening spring adapted for secure positioning on the pivoting joint area of a wire cutting pliers having a pair of cutting edges extends along a first cutting edge of the pliers in an overlapping manner so as to engage and retain a severed wire stub portion in contact with a second cutting edge of the pliers until the pliers are released in preventing the wire stub from being projected away from the pliers. The resilient clip-like retainer/spring biases the pliers to the open configuration and includes a sheath-like covering on the wire engaging portion thereof to enhance its wire retention characteristics.

6 Claims, 10 Drawing Figures

FIG. 1
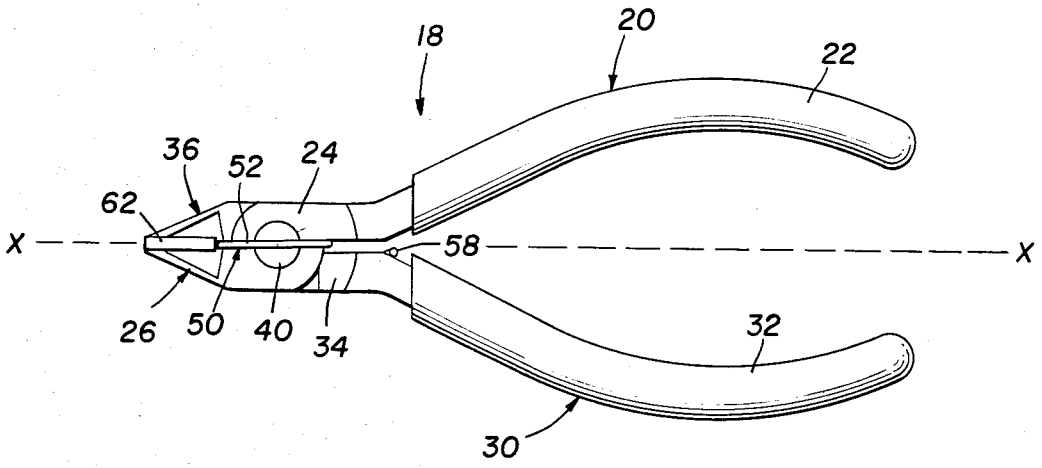
FIG. 2
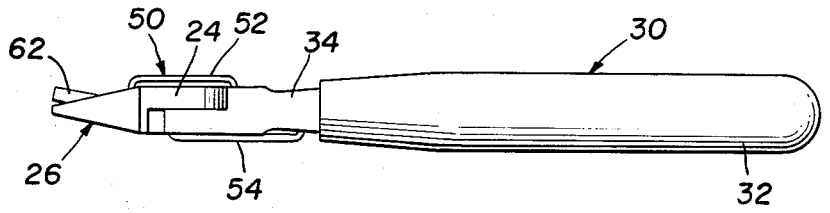
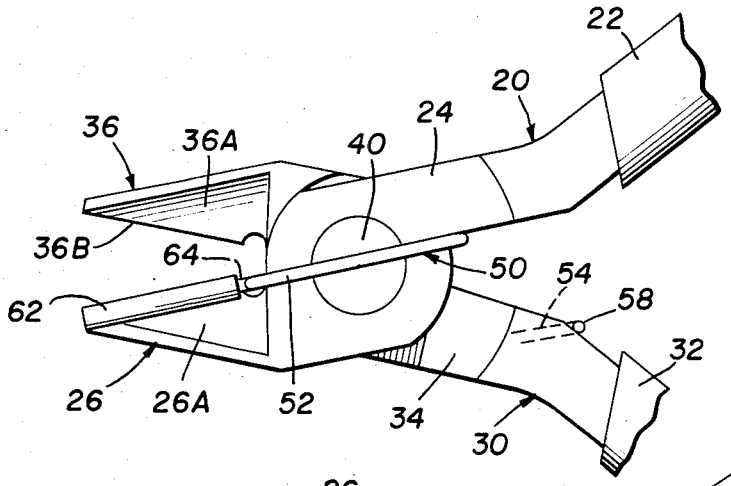
FIG. 3
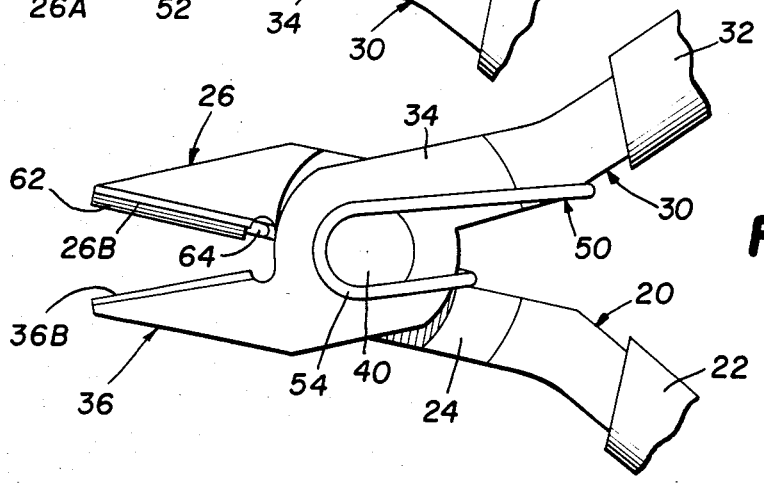
FIG. 4

WIRE STUB RETAINER AND HANDLE OPENING SPRING

BACKGROUND OF THE INVENTION

This invention relates generally to wire cutting apparatus and is more particularly directed to an arrangement for preventing the displacement of a severed wire stub from a wire cutting pliers until the pliers are released and allowed to assume the open configuration.

The manufacture and repair of electronic and electrical apparatus frequently requires the cutting of a small section of wire from a larger piece. This frequently results in the small section of wire, or wire stub, flying through the air at a rapid speed and landing a considerable distance from the location where the wire is cut. This not only presents a hazard to the person cutting the wire and co-workers in the immediate vicinity, but also creates a potential hazard to the electrical equipment being manufactured or repaired in the form of an undesired electrical connection or short circuit. In addition, the flying piece of wire may create a mechanical hazard to machinery in the vicinity of where the wire is cut.

The prior art discloses various approaches for preventing the displacement of a severed wire stub from the cutting pliers. To date, these prior approaches have generally been overly complicated and expensive, and thus not commercially attractive. For example, the wire retaining attachment to the cutting pliers may be comprised of a pair of wire engaging stuctures or a single wire engaging member having a complex shape which is difficult and expensive to fabricate. In addition, the wire engaging member, or members, may be secured to the cutting pliers by means of one or more screws which further complicates the manufacture and assembly of the pliers and thus increases its cost. Often the pliers must be of special design in order to accept a particular wire retainer. Thus, such a retainer would not be attachable to cutting pliers already in use. Finally, prior art wire retaining arrangements in wire cutting pliers have been generally cumbersome to use in that they restrict the user's view of the exact location where the wire is being severed and thus introduce a degree of inaccuracy in the wire cutting process.

The present invention is intended to overcome the aforementioned limitations of the prior art by providing a unitary, resilient, clip-like wire stub retainer and handle opening spring for a wire cutting pliers which prevents a severed wire stub from flying away from the pliers during the wire cutting operation until the cutting pliers are released and which biases the cutting pliers to the open configuration.

SUMMARY OF THE INVENTION

Accordingly, it is an object of the present invention to provide an improved wire cutting pliers.

It is another object of the present invention to provide a wire cutting pliers with a resilient, clip-like structure attached thereto for biasing the pliers to the open configuration and preventing a wire stub from being displaced from the pliers once severed.

Still another object of the present invention is to provide a resilient steel clip adapted for easy insertion on a conventional wire cutting pliers which prevents a severed wire stub from flying through the air.

Yet another object of the present invention is to provide an improved arrangement for retaining a severed wire stub in engagement with a cutting edge of a wire cutting pliers until the pliers are released to the open configuration.

A further object of the present invention is to provide means for biasing a wire cutting pliers to the open configuration and for preventing a severed wire stub from being projected away from the cutting pliers which is easily installed on a conventional wire cutting pliers and requires no additional installation components.

In summary, there is provided a wire retainer for use in a wire cutting pliers having first and second arms pivotally coupled at respective intermediate portions thereof and including respective cutting edges on first ends thereof. The wire retainer comprises a generally C-shaped intermediate portion adapted for close fitting insertion and retention upon the pivotally coupled intermediate portions of the first and second arms, an elongated forward portion extending from the intermediate portion and positioned immediately adjacent to and extending along the length of one of the cutting edges so as to engage and maintain a section of severed wire in firm contact with the other cutting edge when the cutting edges engage the wire, and an aft portion extending from the intermediate portion and positioned in abutting contact with one of the arms for biasing the pliers to an open configuration wherein the cutting edges are displaced from one another.

The invention consists of certain novel features and a combination of parts hereinafter fully described, illustrated in the accompanying drawings, and particularly pointed out in the appended claims, it being understood that various changes in the details may be made without departing from the spirit, or sacrificing any of the advantages of the present invention.

BRIEF DESCRIPTION OF THE DRAWINGS

For the purpose of facilitating an understanding of the invention, there is illustrated in the accompanying drawings a preferred embodiment thereof, from an inspection of which, when considered in connection with the following description, the invention, its construction and operation, and many of its advantages should be readily understood and appreciated.

FIG. 1 is a top plan view of a wire cutting pliers shown in the closed, or wire engaging configuration, including a wire retainer in accordance with the present invention;

FIG. 2 is a lateral view of the wire cutting pliers with a wire retainer shown in FIG. 1;

FIG. 3 is a partial top plan view showing in greater detail the cutting pliers with a wire retainer of FIG. 1 in the open configuration;

FIG. 4 is a partial bottom plan view of the wire cutting pliers with a wire retainer shown in FIG. 3;

DETAILED DESCRIPTION OF THE PREFERRED EMBODIMENT

Figure 5:
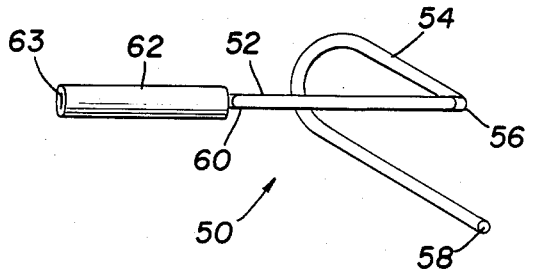
FIG. 5 is a top plan view of a wire retainer for use in a wire cutting pliers in accordance with the present invention.

Referring to FIGS. 1 and 2, there are respectively shown a top plan view and a lateral view of a wire cutting pliers 18 having attached thereto a wire retainer 50 in accordance with the present invention.

The wire cutting pliers 18 includes first and second pivoted cutter arms, or members, 20 and 30. The first pivoted cutter arm 20 includes a handle portion 22 on a first end thereof, an intermediate section 24, and a cutter jaw 26 on a second end thereof. Similarly, the second pivoted cutter arm 30 includes a handle portion, or grip, 32 on a first end thereof, an intermediate section 34, and a cutter jaw 36 on a second end thereof. The first and second cutter arms 20, 30 are pivotally coupled at the respective intermediate sections thereof by a pivot pin 40 which extends through the first and second intermediate sections 24, 34. The first and second pivoted cutter arms 20, 30 are essentially identical in configuration and construction and are positioned in facing relation such that the respective intermediate sections thereof are in contact with one another so as to permit relative rotational displacement therebetween about the pivot pin 40. The first and second pivoted cutter arms 20, 30 are configured and coupled to one another such that a handle portion of a given cutter arm is positioned on one side of a centerline, indicated as line X—X in FIG. 1, extending through the wire cutting pliers, while a cutter jaw portion of that same pivoted cutter arm is positioned on the opposite side of the centerline X—X. Thus, the handle portion 22 of the first pivoted cutter arm 20 is positioned on the same side of the centerline X—X as the cutter jaw 36 of the second pivoted cutter arm 30 as shown in FIG. 1. Similarly, as shown in FIG. 2 the intermediate section 24 of the first pivoted cutter arm 20 is positioned above the intermediate section 34 of the second pivoted cutter arm 30, with the pivot pin 40 extending through each of the intermediate sections in providing a pivoting coupling arrangement therebetween.

Figure 7:
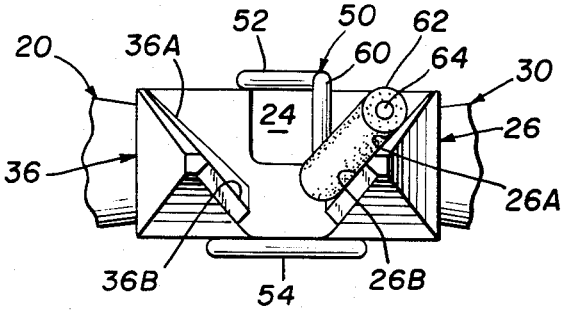
FIG. 7 is an end-on, front view of the wire cutting pliers with a wire retainer as shown in FIG. 3 with the wire cutting pliers in the open configuraton.

Referring to FIGS. 3 and 4, there are respectively shown partial top and bottom plan views of the wire cutting pliers 18 in greater detail with the pliers in the open, or released, configuration. From FIGS. 3 and 4, it can be seen that the cutter jaw 26 of the first pivoted cutter arm 20 includes an inner side portion 26A and a cutter jaw, or edge, 26B. Similarly, the cutter jaw 36 of the second pivoted cutter arm 30 includes an inner side portion 36A and a cutter jaw 36B. Each of the inner side portions 26A, 36A is angled downwardly so as to form in combination, with the wire cutting pliers 18 in the closed configuration, a generally V-shaped recessed portion between the respective cutter jaws as shown in FIGS. 7 and 9 which are respectively end-on, front views of the wire cutting pliers in the open and closed configurations. In the open configuration, a wire 66 to be severed is positioned between the respective cutter edges 26B, 36B of the first and second pivoted cutter arms 20, 30 (see FIG. 8). With the respective handle portions 22, 32 of the first and second pivoted cutter arms 20, 30 displaced toward one another, a corresponding displacement between the respective cutter edges 26B, 36B of the cutter arms occurs to cause the cutter edges to be positioned in abutting contact and sever a wire positioned therebetween.

Figure 6:
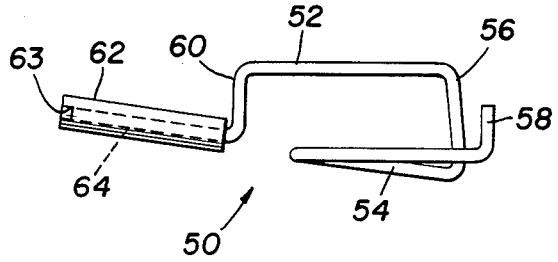
FIG. 6 is a lateral view of the wire retainer of FIG. 5.

Mounted to the wire cutting pliers 18 shown in FIGS. 1–4 and FIG. 7, is a wire retainer 50 in accordance with the present invention. The configuration and operation of the wire retainer 50 will now be described in detail with regard to the aforementioned figures as well as FIGS. 5 and 6, which respectively show top plan and lateral views of the wire retainer 50. The retainer 50 is formed of a single piece of steel wire in a preferred embodiment and includes a resilient sheath 62 positioned on a forward section 64 thereof.

The wire retainer 50 includes coupled upper intermediate, lower intermediate and aft connecting sections 52, 54 and 56. These three sections of the wire retainer 50 form a generally C-shaped member which is adapted for insertion in a tight fitting manner upon the first and second intermediate sections 24, 34 of the first and second pivoted cutter arms 20, 30. Coupled to one end of the upper intermediate section 52 of the wire retainer 50 is a forward connecting section 60 which is positioned in abutting contact with a forward portion of the intermediate section 24 of the first pivoted cutter arm 20. Thus, the generally C-shaped, open configuration of the combination of the forward and aft connecting sections 56, 60 as well as the upper and lower intermediate sections 52, 54 is positioned around so as to substantially enclose the combination of the first and second pivotally coupled intermediate sections 24 and 34. Extending from a lower end portion of the forward connecting section 60 is an elongated, linear forward section 64 which is positioned immediately adjacent to and substantially along the length of the cutter edge 26B of the first pivoted cutter arm 20. The elongated forward section 64 of the wire retainer 50 is adapted to receive substantially along the entire length thereof the aforementioned resilient sheath 62. The sheath 62 includes an elongated aperture, or channel, 63 extending the length thereof within which the forward section 64 of the retainer 50 is inserted. In a preferred embodiment, the sheath 62 is comprised of a compressible material with a surface having a high coefficient of friction, such as silicone, to securely engage and retain a wire stub following its severance by the first and second cutting jaws 26, 36.

One end of the lower intermediate section 54 of the wire retainer 50 is coupled to the lower end portion of the aft connecting section 56 thereof. As shown in the various figures, the lower intermediate section 54 is generally curvilinear in shape, such as in the general form of a "U". However, the lower intermediate section 54 is not limited to this shape, as any configuration which extends generally parallel to the upper intermediate section 52 and permits the first and second intermediate sections 24, 34 of the cutter arms to be inserted therebetween in tight fitting relation will suffice. The lower intermediate section 54 is positioned immediately beneath and in abutting contact with the second intermediate section 34 of the second pivoted cutter arm 30. A second end of the lower intermediate section 54 is coupled to an aft engaging section 58 which is positioned in abutting contact with an inner surface of the second pivoted cutter arm 30. The shape of the wire retainer 50 is such that the aft engaging section 58 exerts an outward biasing force upon the second pivoted cutter arm 30, while the combination of the forward section 64 of the wire retainer 50 and the sheath 62 positioned thereon exerts an outward force upon the first pivoted cutter arm 20 so as to bias the wire cutting pliers 18 in the open configuration. With the respective forces exerted by the forward and aft sections of the wire retainer 50 positioned on opposite sides of the pivot pin 40 and exerted upon a respective pivotally coupled cutter arm, the first and second cutter arms 20, 30 are urged away from one another causing the wire cutting pliers 18 to assume an open configuration when released as shown in FIGS. 3 and 4.

Figure 8:
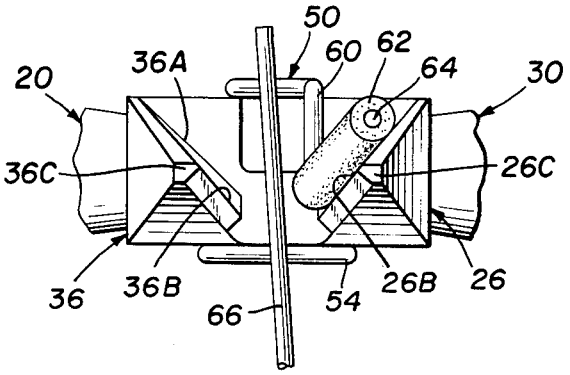
FIG. 8 is an end-on, front view of the wire cutting pliers with a wire retainer of FIG. 7 showing a section of wire to be severed positioned therein.
Figure 9:
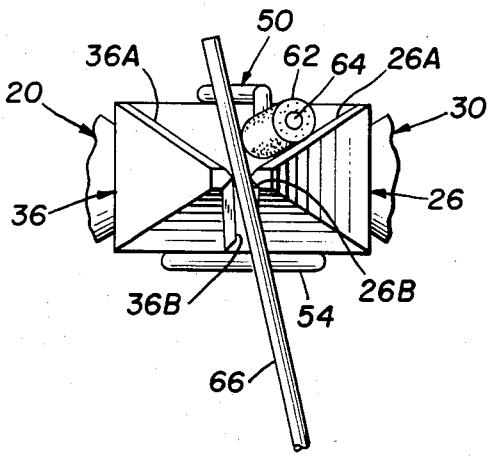
FIG. 9 is a view of the wire cutting pliers with a wire retainer of FIG. 8 wherein the wire is engaged by the cutting edges of the pliers prior to being severed.
Figure 10:
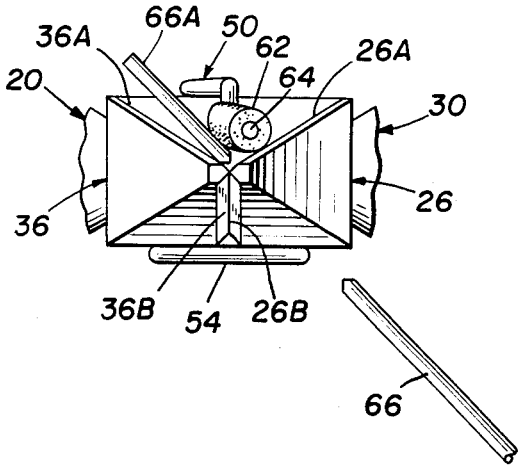
FIG. 10 is a view of the wire cutting pliers with a wire retainer of FIG. 9 with the wire severed and the severed portion engaged by the wire retainer in accordance with the present invention.

Referring to FIGS. 8, 9 and 10, there is shown the manner in which a wire 66 is engaged, severed and retained by the wire cutting pliers 18 having a wire retainer 50 in accordance with the present invention. As shown in FIG. 8, the wire 66 is positioned intermediate the first and second cutter jaws 26, 36. From the figure, it can be seen that the sheath 62 is positioned in contact with the inner side 26B of the first cutter jaw 26. The forward portions of the first and second cutter jaws 26, 36 include respective forward tips designated as elements 26C and 36C, respectively. As shown in FIG. 9, as the first and second cutter jaws 26, 36 of the wire cutting pliers 18 are displaced toward one another so as to engage the wire 66, the sheath 62 positioned upon the forward section 64 of the wire retainer 50 also engages the wire 66. In FIG. 9, the respective cutter edges 26B and 36B of the first and second cutter jaws 26, 36 are shown engaging respective lateral portions of the wire 66. Upon further displacement of the respective cutter edges of the first and second cutter jaws 26, 36 toward one another, as shown in FIG. 10, the wire 66 is severed by the cutter edges and the sheath 62 engages a severed, stub portion 66A of the wire and holds it securely against the inner side 36A of the second cutter jaw 36. The wire stub 66A is held firmly between the sheath 62 and the inner side 36A of the second cutter jaw 36 until the wire cutting pliers is released and the respective cutter jaws are displaced away from one another by means of the aforementioned biasing action of the wire retainer 50. With the sheath 62 preferably comprised of a somewhat rough textured, compressible material such as silicone or rubber, the wire stub 66A is prevented from being propelled away from the wire cutting pliers when severed from the wire 66. Then, when the pliers are released, the retainer 50 biases the arms 20 and 30 outwardly to place the jaws 26 and 36 in their open condition, thereby automatically releasing the cut piece of wire 66A which had been held by the sheath 62. Because the sheath 62 is compressible, the wire 66 can have a variety of diameters and yet be retained by such sheath.

It is of interest that the cut wire stub 66A ends of the wire 66 are V-shaped as the result of the V shape on the jaws 26 and 36. It is to be understood that these jaws can have a modified shape so that the cut ends of the wire 66 are straight.

It is important that the sheath 62 not extend further than the tips of the cutting edges of the pliers in order to enable the tip of the pliers to be placed against the workpiece. In other words, it is important that the sheath itself not interfere with the usual performance of this kind of cutting pliers.

There has thus been shown a wire stub retainer and handle opening spring for use in a wire cutting pliers which prevents a severed wire stub from being projected away from the main wire section upon its severance therefrom. The wire stub is maintained in firm engagement with the cutting portion of the pliers, which are biased to the open position by means of the combination wire stub retainer and handle opening spring until the pliers are released. The wire stub retainer of the present invention, which preferably is comprised of a single piece of spring steel wire, is adapted to be securely positioned upon the overlapping, pivoting portions of the wire cutting pliers and retained thereon in tight fitting relation. Finally, and most importantly, the wire stub retainer is adapted for use on existing pliers without modification thereof.

We claim:

1. For use in a wire cutting pliers having first and second arms pivotally coupled at respective intermediate portions thereof and including respective cutting edges on first ends thereof, a resilient wire retainer comprising an intermediate mounting portion adapted to receive and grip the pivotally coupled intermediate portions of the first and second arms, for mounting thereon by gripping engagement therewith solely by reason of the shape of said intermediate mounting portion and without any other attachment means said mounting portion having opposed top and bottom portions for respectively engaging the pivotally coupled intermediate portions along the top and bottom thereof and opposed end portions for respectivey engaging the pivotally coupled intermediate portions along front and rear ends thereof, an elongated forward portion extending from said intermediate mounting portion and positioned immediately adjacent to and extending along the length of one of the cutting edges so as to engage and maintain a section of severed wire in firm contact with the other cutting edge when the cutting edges engage the wire, and an aft portion extending from the rear most part of said intermediate mounting portion substantially perpendicular to said top and bottom portions and terminating in a free distal end, said after portion being positioned in abutting contact with one of the arms for biasing the pliers to an open configuration wherein the cutting edges are displaced from one another.

2. The wire retainer of claim 1, wherein said forward portion includes a compressible sheath on the surface thereof for exerting an engaging force upon the section of severed wire.

3. The wire retainer of claim 2, wherein said sheath is composed of silicone.

4. The wire retaier of claim 2, wherien the retainer is constructed such that the end of said sheath is coterminous with the ends of the cutting edges.

5. The wire retainer of claim 1, being composed of a unitary piece of steel spring wire.

6. The wire retainer of claim 1, wherein the aft portion thereof is adapted to engage an inner portion of one of the arms toward a second end thereof.

* * * * *

UNITED STATES PATENT AND TRADEMARK OFFICE

CERTIFICATE OF CORRECTION

PATENT NO. : 4,627,164

DATED : December 9, 1986

INVENTOR(S) : Frank Mikic and Daniel W. Williams

It is certified that error appears in the above-identified patent and that said Letters Patent is hereby corrected as shown below:

Column 6, line 31, "respectivey" should be --respectively--;

line 42, "after" should be --aft--;

line 53, "retaier" should be --retainer--;

line 53, "wherien" should be --wherein--.

Signed and Sealed this

Fourth Day of April, 1989

*Attest:*

*Attesting Officer*

DONALD J. QUIGG

*Commissioner of Patents and Trademarks*